United States Patent [19]

Reverberi

[11] 4,426,740

[45] Jan. 24, 1984

[54] WATER-PROOF GARMENT HORIZONTALLY FOLDABLE

[76] Inventor: Léo Reverberi, 5, passage de la Main d'Or, Paris XI$^{e}$, France, 75011

[21] Appl. No.: 208,235

[22] Filed: Nov. 10, 1980

[30] Foreign Application Priority Data

Nov. 16, 1979 [FR] France ..... 79 28384
Aug. 20, 1980 [FR] France ..... 80 18172

[51] Int. Cl.$^{3}$ ..... A41D 3/08
[52] U.S. Cl. ..... 2/84; 2/88
[58] Field of Search ..... 2/84, 88, DIG. 7, 114, 2/93, 247

[56] References Cited

U.S. PATENT DOCUMENTS

| | | | |
|---|---|---|---|
| 2,139,579 | 12/1938 | Dier | 2/84 X |
| 2,142,814 | 1/1939 | Fitch | 2/93 |
| 2,982,967 | 5/1961 | Parker et al. | 2/84 X |
| 3,042,931 | 7/1962 | Sawyer | 2/84 X |
| 3,161,887 | 12/1964 | Silver | 2/88 |
| 3,720,957 | 3/1973 | Patience | 2/DIG. 7 |

FOREIGN PATENT DOCUMENTS

| | | | |
|---|---|---|---|
| 828605 | 8/1975 | Belgium . | |
| 434554 | 9/1926 | Fed. Rep. of Germany . | |
| 874882 | 4/1953 | Fed. Rep. of Germany | 2/88 |
| 807923 | 3/1954 | Fed. Rep. of Germany | 2/84 |
| 892645 | 1/1944 | France . | |
| 1142371 | 4/1957 | France . | |
| 1306717 | 9/1962 | France | 2/88 |
| 2282821 | 3/1976 | France . | |

*Primary Examiner*—H. Hampton Hunter

[57] ABSTRACT

There is disclosed a water-proof garment which is horizontally foldable to form a belt-like member to be worn around the waist when not in use.

12 Claims, 35 Drawing Figures

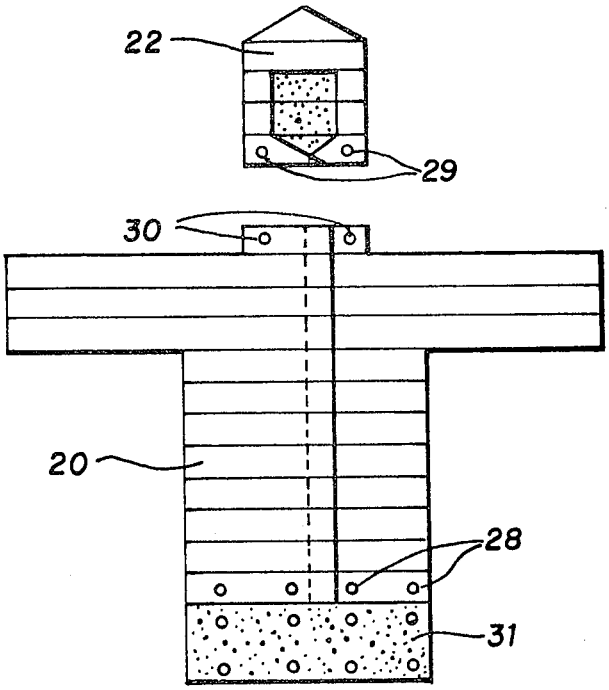
Fig. 9
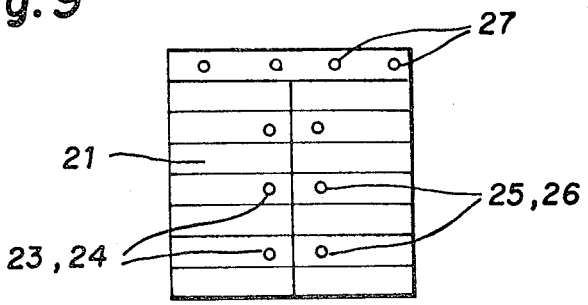

Fig. 10
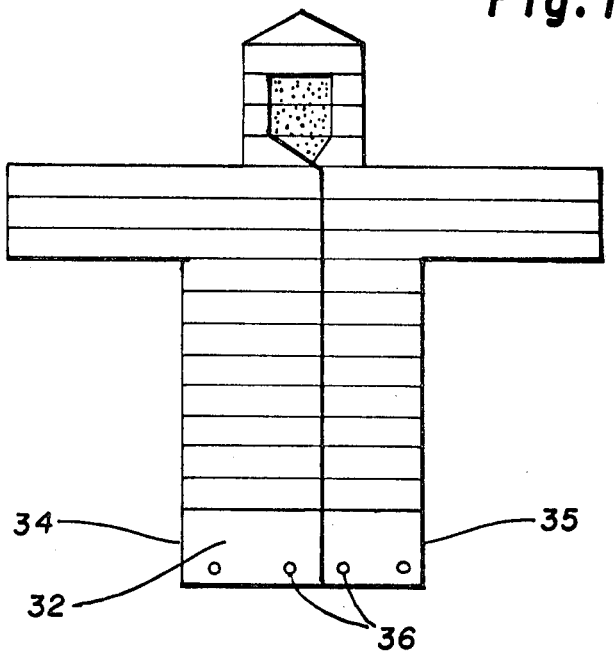
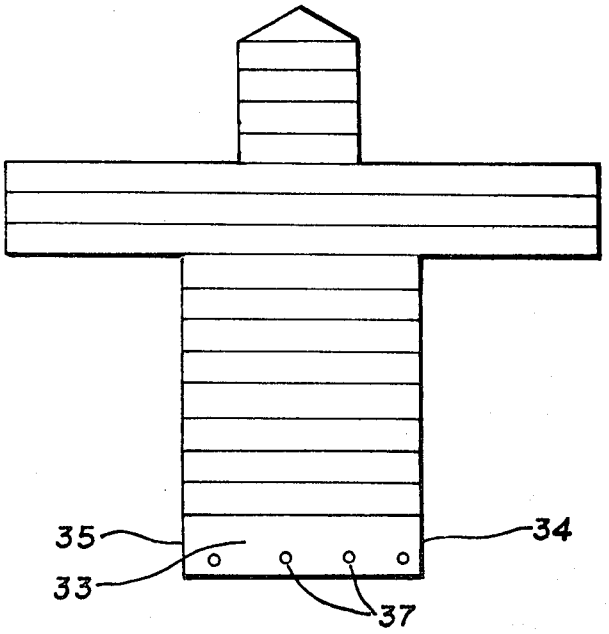
Fig. 11

Figure 1:
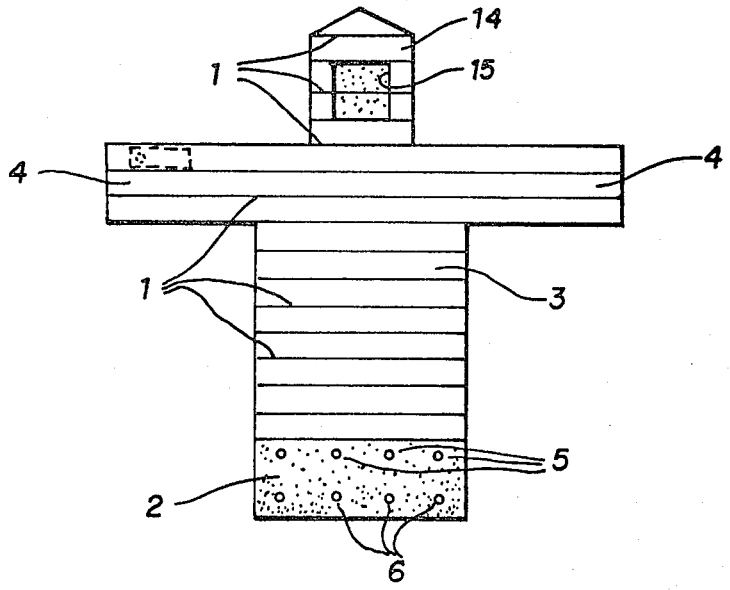
Figure 2:
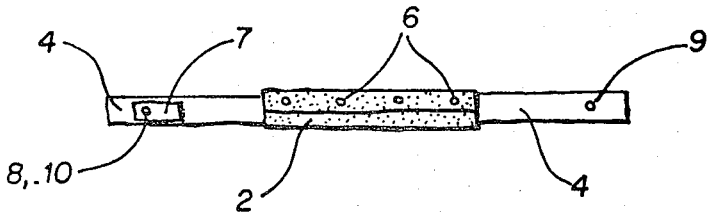
Figure 3:
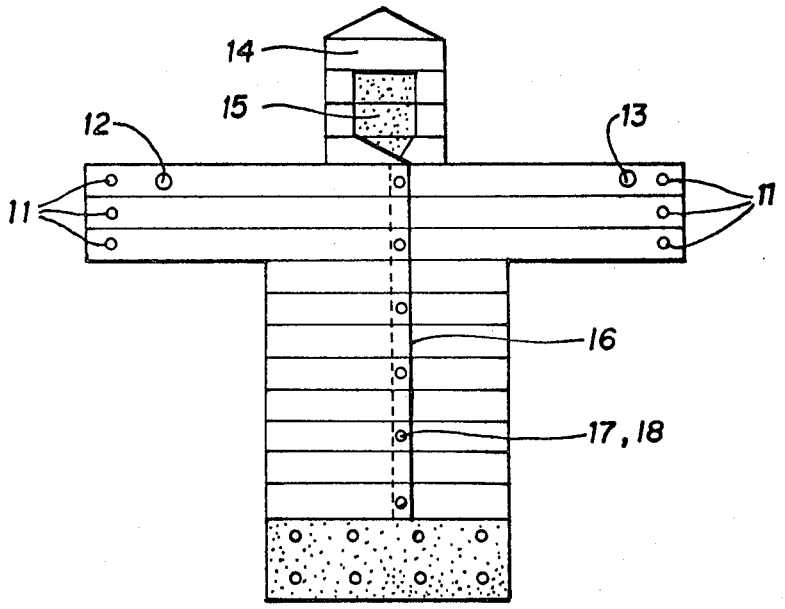
Figure 4:
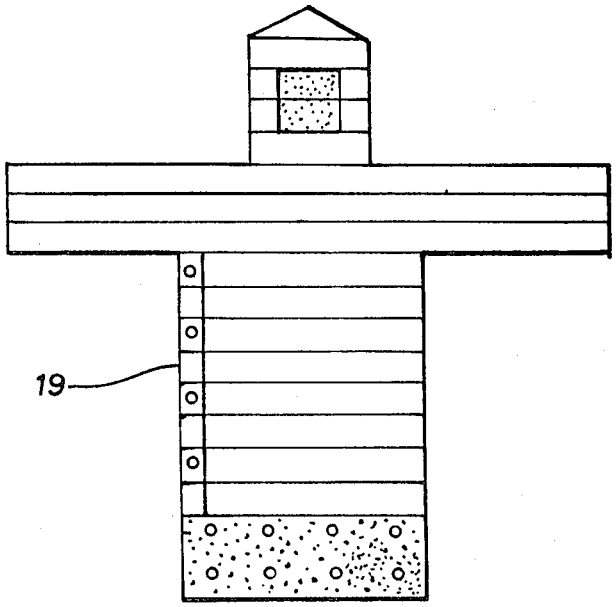
Figure 5:
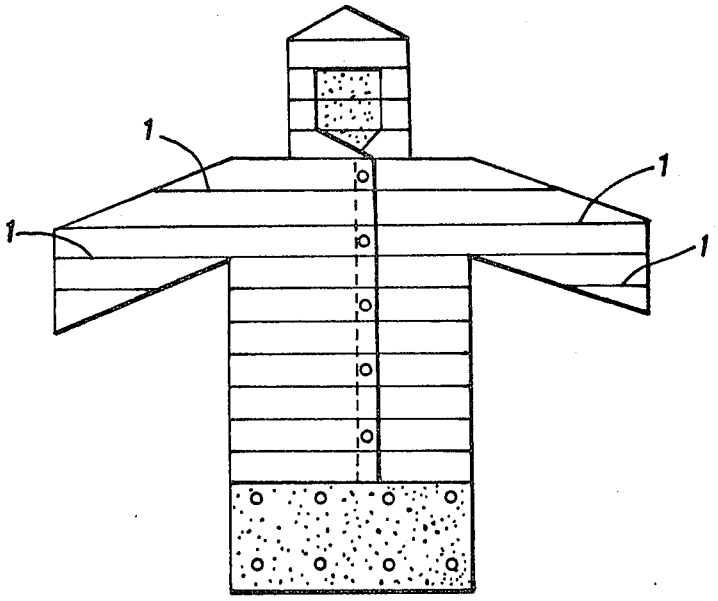
Figure 6:
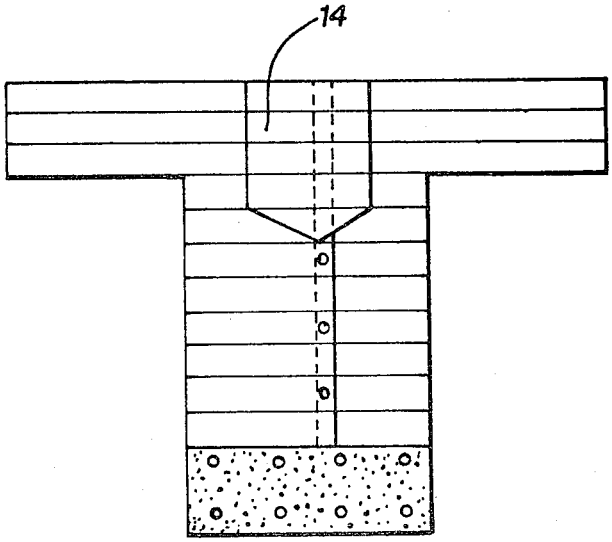
Figure 7:
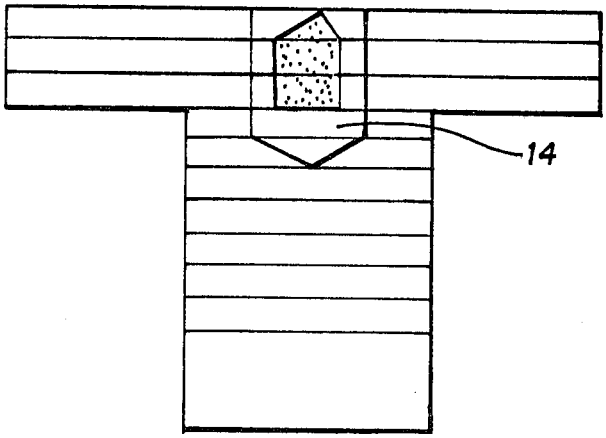
Figure 8:
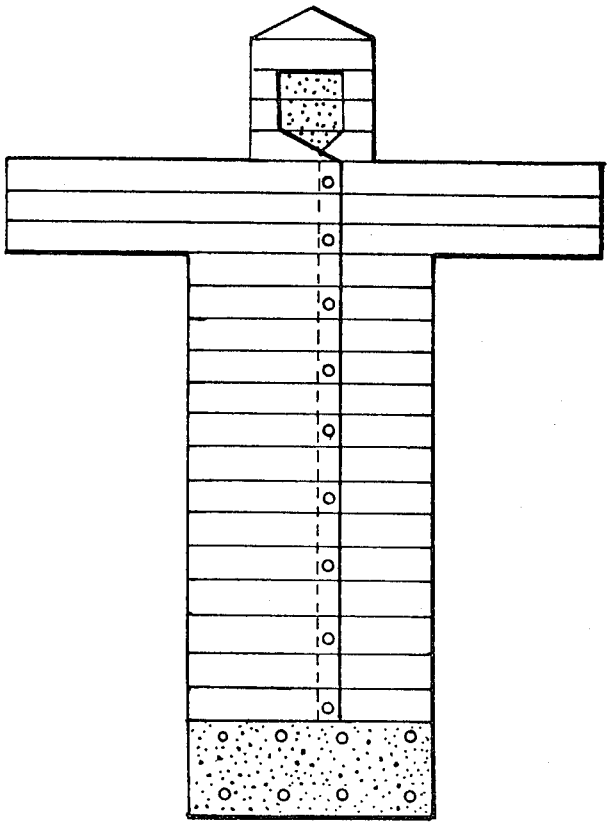
Figure 12:
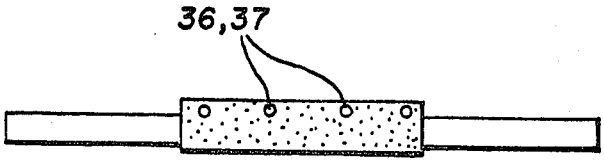
Figure 13:
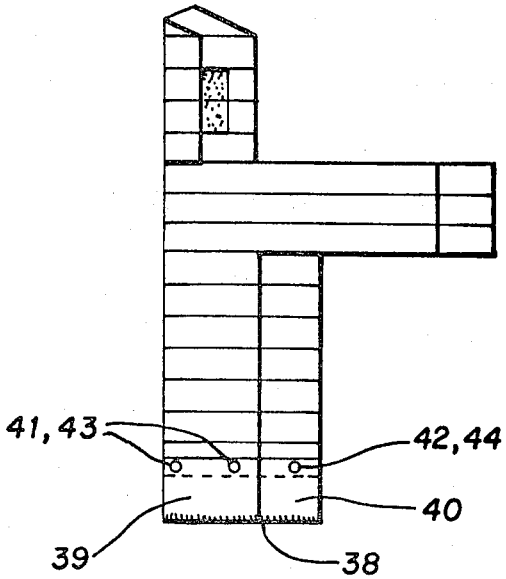
Figure 14:
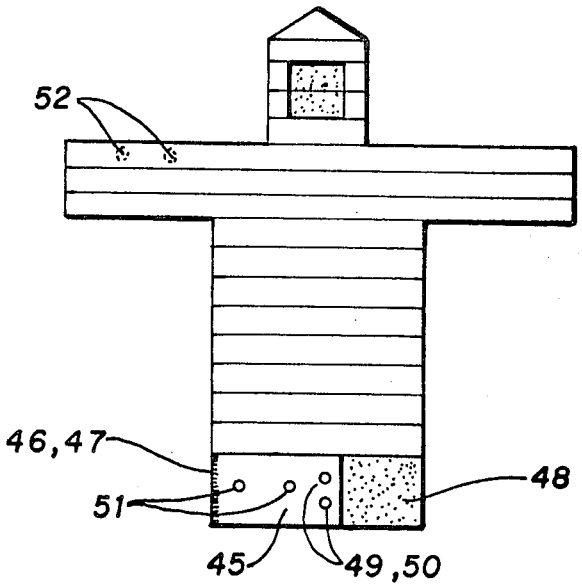
Figure 15:
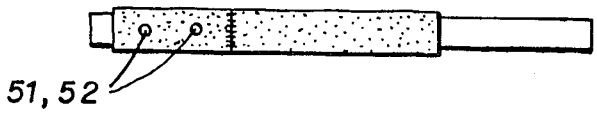
Figure 16:
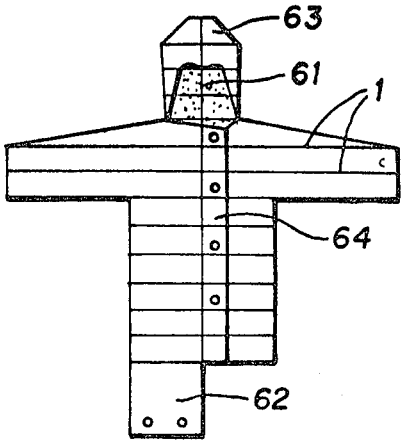
Figure 17:
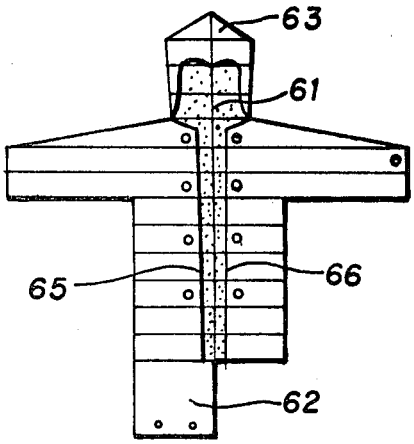
Figure 18:
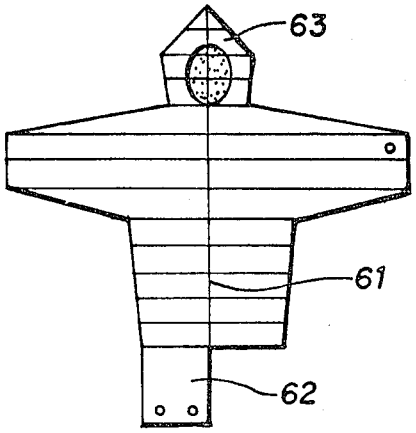
Figure 19:
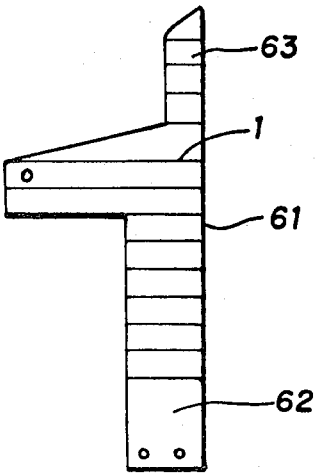
Figure 20:
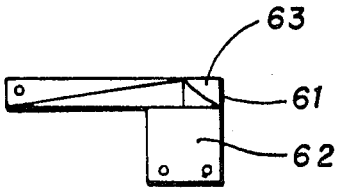
Figure 21:
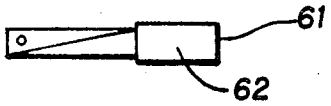
Figure 22:
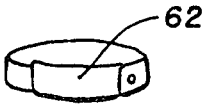

FIG. 18 shows a garment which is not open at the front but which still is provided with the vertical fold-line 61. As shown in FIG. 19, any of the embodiments of FIGS. 16, 17, and 18 can be folded in half about the vertical fold-line 61, the horizontal fold-lines 1 being in register. Thereafter, the garment is folded in accordeon-like fashion, as shown in FIG. 20, using the horizontal fold-lines 1. Then the assembly of the pleats of the garment body is enclosed by the closing marginal portion 62, as shown in FIG. 21. The fully-folded garment is then ready to be worn around the wearer's waist, being attached by suitable fastener means, as shown in FIG. 22.

Figure 23:
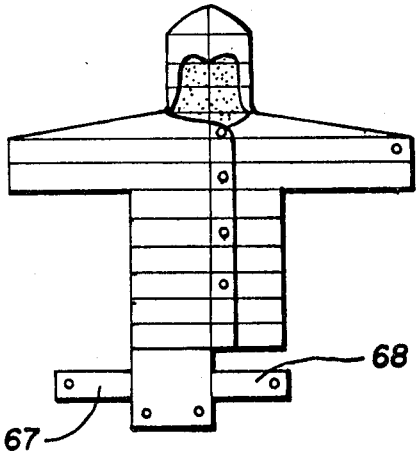
Figure 24:
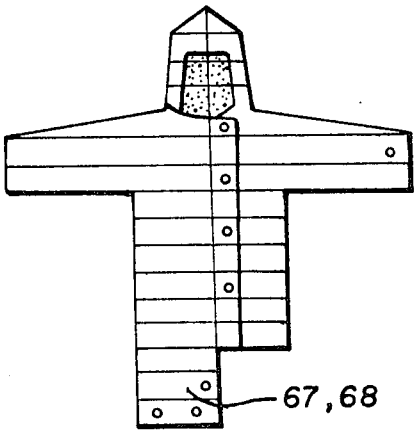
Figure 25:
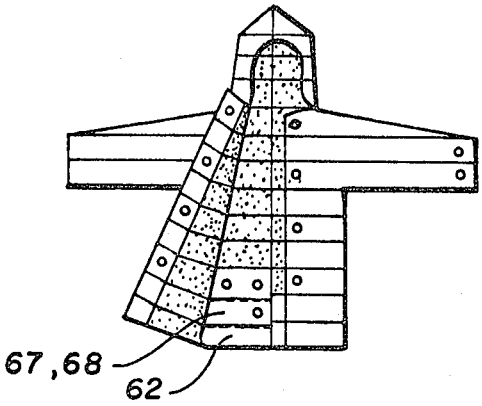
Figure 26:
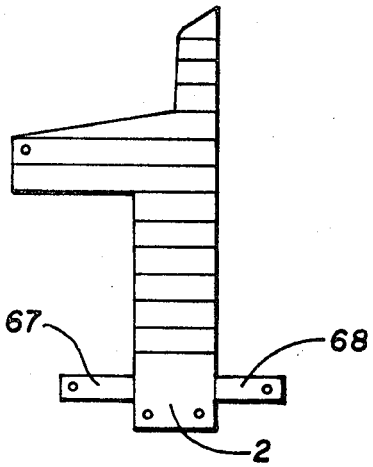
Figure 27:
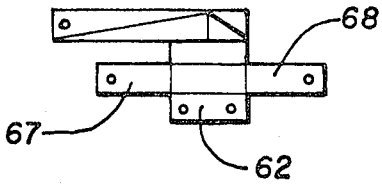
Figure 28:
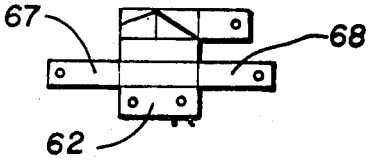
Figure 29:
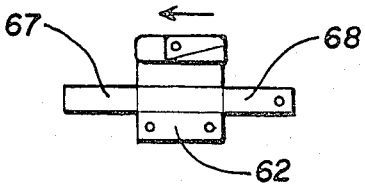
Figure 30:
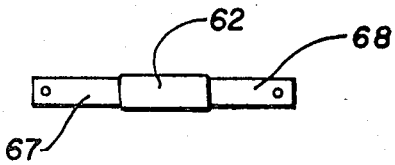
Figure 31:
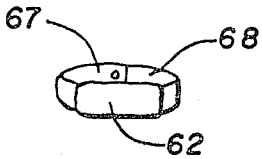

FIG. 23 shows still another embodiment wherein two tabs 67 and 68, each of rectangular shape and of a width substantially equal to the width of the pleats, are attached at one end to the side edges of the closing marginal portion 62. These tabs 67 and 68 may be of various lengths. These tabs 67 and 68 are secured to marginal portion 62, either by stitching, by welding or, preferably, by means of rivets which will permit these tabs to pivot. However, these tabs can be made an integral part of marginal portion 62. When the garment is used against the rain, tabs 67 and 68 are folded one against the other over the marginal portion 62, as shown in FIG. 24, and are maintained in this folded position by suitable fastener means. Then, as shown in FIG. 25, the marginal portion 62 is itself folded back against the inside of the garment and is maintained in said position by suitable fastener means. When the garment is intended to be worn around one's waist, the two halves of the garment are folded one against the other along the vertical fold-line 61, as shown in FIG. 26, then folded about the horizontal fold-lines 1 in accordeon-like manner, as shown in FIG. 27. Before closing the marginal portion 62, the assembly of the folded arm sleeves is folded back on one side of the garment body, as shown in FIG. 28. Then the protruding part of the folded arm sleeves is folded back in the reverse direction over the other side of the garment body, as shown in FIG. 29. If necessary, suitable fastener means maintain the garment in this folded position. Thereafter, tabs 67 and 68 are extended and the marginal portion 62 is folded around the fully-folded garment and now has the condition shown in FIG. 30. The garment can then be attached around the wearer's waist by the outer ends of the tabs 67 and 68, which have cooperating fastener means, and is now in the position shown in FIG. 31.

As seen, the garment forms a rectangular packet which can be easily positioned in the hollow formed by the lombar region.

With respect to the two embodiments shown in FIGS. 16 to 22 and 23 to 31, additional details are furnished. In both embodiments, the marginal portion 62 is stitched or welded to the lower edge of the garment, with marginal portion 62 flat against the inside of the garment. The lowest pleat of the garment will also be slightly wider than the other pleats, in order that, when the garment has been inserted in folded condition within the marginal portion 62, the joint formed by the edges of the marginal portion and of the lowest pleat will form a well-defined edge.

The marginal portion 62, and also the tabs 67 and 68, may not be made of water-proof material, since they are located within the garment when the latter is worn against rain. This has the additional advantage of preventing condensation from perspiration when the garment is worn around one's waist.

There are two manners of enclosing the folded garment within the marginal portion 62: the first manner is by using a short marginal portion 62 which will be attached by its fastener means to fastener means secured to the last pleat of the garment. The second manner uses a longer marginal portion which will completely surround the folded garment and whereby the marginal portion will be attached to itself by fastener means secured to itself in the region of its junction with the last pleat.

There exist two manners of wearing the folded garment about one's waist: the first manner is to position the flat side against the wearer's back with the prominent side at the exterior; the second manner consists of placing the prominent side against the back while leaving the flat side at the exterior.

In order to hide from view the folds of the garment on each side of the prominence, a small tab can be fixed to each side of the marginal portion. These additional tabs will be fixed by fastener means to cooperable fastener means fixed to each tab 67, 68.

In order to ensure the water-proofness of the garment, especially when the front and back parts are assembled by stitching, it is advisable to overlap the stitching joint with tapes to form a water-proof joint.

Figure 32:
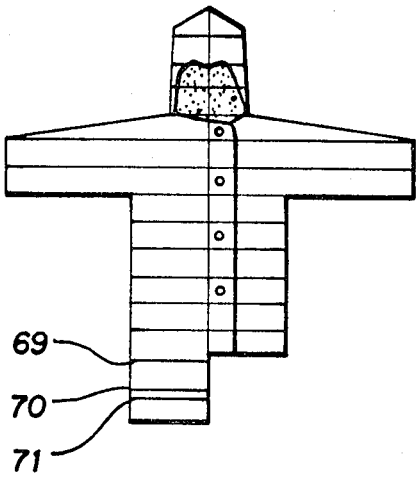

In order that the marginal portion 62 has a well-defined shape when enclosing the folded garment, it is necessary that this marginal portion be provided with permanent horizontal fold-lines, as indicated in FIG. 32, at 69, 70, and 71.

Figure 33:
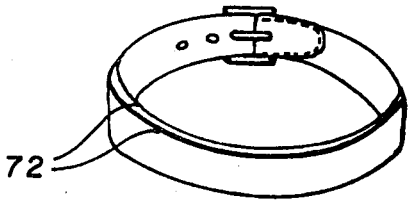
Figure 34:
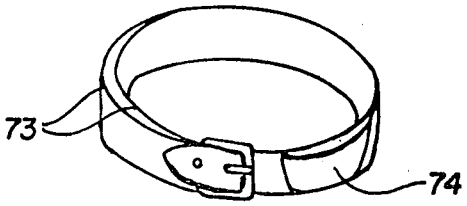
Figure 32:
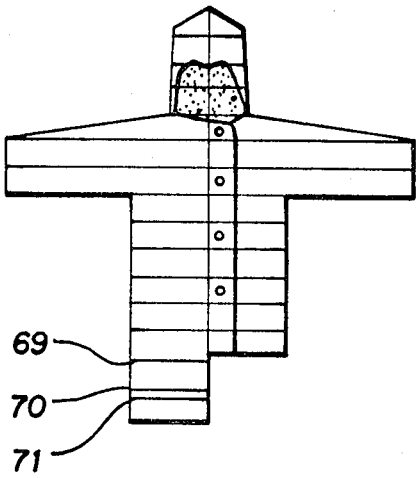
Figure 33:
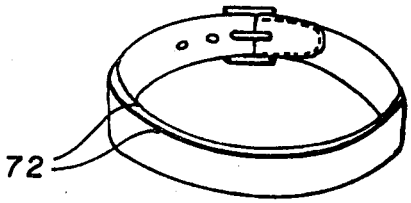
Figure 35:
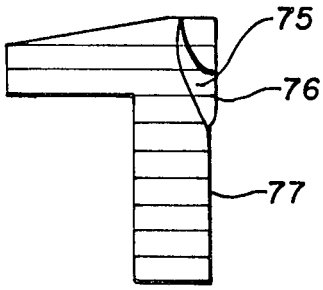
Figure 34:
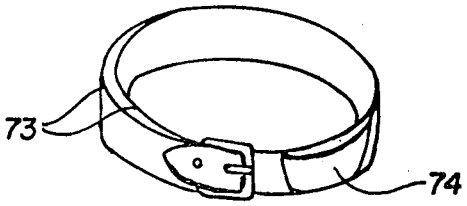

For certain applications, the marginal portion 62, together with the tabs 67 and 68, can be dispensed with and replaced by a case-forming belt, as shown in FIG. 33. This belt is provided with a double-wall construction forming a case, as shown at 72, which is preferably provided in the center portion of the belt, so as to be positioned at the back of the wearer in the hollow formed by the lombar region. This case-forming belt can be made of any non-water-proof fabric in order to absorb humidity from perspiration. However, the inside of the case can be made water-proof in order to protect the wearer when a wet folded garment is inserted into the case. This belt can have additional small compartments, as shown at 73 and 74 in FIG. 34, adapted to receive various items, such as coins, keys, identification cards and the like.

Figure 35:
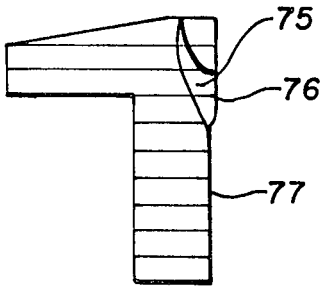

FIG. 35 shows a modification of the manner of folding the garment. The hood 75 is first bodily folded about a neck horizontal fold-line 1, whereby after folding the garment itself about its vertical fold-line 61, the hood is astride the garment body portion with its central edge 76 registering with the central edge 77 of the body portion. The garment is then folded in accordeon-like manner, as in the previous embodiments. The hood could be folded in this manner over the front part of the garment with the edge formed by the central vertical fold-line of the hood entering within the hollow formed by the vertical fold-line of the garment body portion. The hood would thus be sandwiched between the two parts ot the garment.

What I claim is:

1. A water-proof garment forming a body portion and arm sleeves made of a back part and of a front part which can be laid flat one against the other with the arm sleeves extended and flat, said body portion defining a longitudinal vertical central axis with the arm sleeves transverse to said axis, said front and back part being provided with a plurality of equally-spaced permanent-